United States Patent [19]

James et al.

[11] 4,123,202

[45] Oct. 31, 1978

[54] HYDRAULIC PUMPING ARRANGEMENTS

[75] Inventors: Nicholas A. James, Wotton-under-Edge; John A. Hudson, Highworth; Derek G. Savage, Swindon; Edward G. Morley, Tetbury, all of England

[73] Assignee: Plessey Handel und Investments AG, Zug, Switzerland

[21] Appl. No.: 738,625

[22] Filed: Nov. 3, 1976

[30] Foreign Application Priority Data

Nov. 4, 1975 [GB] United Kingdom ..... 45724/75

[51] Int. Cl.[2] ..... F04B 49/00

[52] U.S. Cl. ..... 417/216; 60/405; 60/450

[58] Field of Search ..... 60/403, 405, 406, 445, 60/450, 452; 417/218–222, 216, 426, 429, 217

[56] References Cited

U.S. PATENT DOCUMENTS

| | | | |
|---|---|---|---|
| 2,502,546 | 4/1950 | Adams | 417/222 X |
| 2,638,973 | 5/1953 | Carey | 417/216 X |
| 3,067,693 | 12/1962 | Lambeck | 417/219 |
| 3,434,282 | 3/1969 | Shelhart | 60/405 |
| 3,526,468 | 9/1970 | Moon et al. | 417/216 X |
| 3,623,321 | 11/1971 | Schwerin | 60/452 X |
| 3,788,773 | 1/1974 | Van der Kolk | 417/217 X |
| 3,856,436 | 12/1974 | Lonnemo | 60/450 X |
| 3,865,514 | 2/1975 | Lonnemo | 60/452 X |
| 3,913,324 | 10/1975 | Miller et al. | 60/405 |

FOREIGN PATENT DOCUMENTS

| | | | |
|---|---|---|---|
| 2,363,480 | 6/1975 | Fed. Rep. of Germany | 417/221 |

*Primary Examiner*—Carlton R. Croyle
*Assistant Examiner*—Edward Look
*Attorney, Agent, or Firm*—Fleit & Jacobson

[57] ABSTRACT

A hydraulic pumping arrangement for pumping a liquid to a hydraulic system, which comprises pumping means for pumping the liquid, swash means including a variable swash member which enables the liquid output of the pumping means to be infinitely varied between minimum and maximum, a first piston-and-cylinder arrangement for increasing the position of the swash member to increase the liquid output of the pumping means, a second piston-and-cylinder arrangement for decreasing the position of the swash member to decrease the liquid output of the pumping means, control means for controlling the flow of liquid for the second piston-and-cylinder arrangement, switching means operative to pass liquid from the system to the control means at a first condition in the system and operative to stop liquid from the system passing to the control means at a second condition in the system, and valve means for isolating the pumping arrangement from the system and from a main pump normally supplying liquid to the system, the control means being operative when it is receiving liquid from the switching means to enable the swash member to be moved to an on-swash condition and therefore the pumping means to pump liquid to the system in the event of a lack of liquid output from the main pump.

7 Claims, 4 Drawing Figures

HYDRAULIC PUMPING ARRANGEMENTS

This invention relates to hydraulic pumping arrangements and relates more especially to a hydraulic pumping arrangement for pumping a liquid to a hydraulic system Accordingly, this invention provides a hydraulic pumping arrangement for pumping a liquid to a hydraulic system, which comprises pumping means for pumping the liquid, swash means including a variable swash member which enables the liquid output of the pumping means to be infinitely varied between minimum and maximum, a first piston-and-cylinder arrangement for increasing the position of the swash member to increase the liquid output of the pumping means, a second piston-and-cylinder arrangement for decreasing the position of the swash member to decrease the liquid output of the pumping means, control means for controlling the flow of liquid for the second piston-and-cylinder arrangement, switching means operative to pass liquid from the system to the control means at a first condition in the system and operative to stop liquid from the system passing to the control means at a second condition in the system, and valve means for isolating the pumping arrangement from the system and from a main pump normally supplying liquid to the system, the control means being operative when it is receiving liquid from the switching means to enable the swash member to be moved to an on-swash condition and therefore the pumping means to pump liquid to the system in the event of a lack of liquid output from the main pump.

Various types of non-return valve may be employed as the valve means, although it is presently preferred to employ a non-return ball valve. preferably includes a control orifice which operates together with the second piston-and-cylinder arrangement and the control means to enable a precise control to be achieved over the output of the pumping means, whereby the amount of liquid pumped when the pumping means is fully operative and is not a stand-by condition can be precisely controlled. The control orifice may be a fixed hole or it may be a variable orifice such as is obtained when a spool valve is employed moving relative to a fixed orifice in a cylinder wall.

Preferably the switching means is sensitive to pressure so that the switching means is operative to pass liquid from the system to the control means at a first pressure condition in the system and is operative to stop liquid from the system passing to the control means at a second pressure condition in the system. The first pressure condition may be arranged to occur at a lower pressure than the second pressure condition. Usually, each of the first and second pressure conditions will extend over a range of pressures, although it is preferred that the pump will be such that the switching means is operative only at two specific pressures. If desired, the switching means can alternatively be sensitive to liquid flow.

Preferably, the switching means includes a spool valve, and the pumping means is a reversible pump. Obviously, other types of switching means and pump may be employed.

The liquid being pumped may be oil for a hydraulic control system or it may be petrol or other fuel for a fuel system.

A hydraulic pumping arrangement in the form of an actual pump will now be described solely by way of example and with reference to the accompanying drawings in which.

Figure 1:
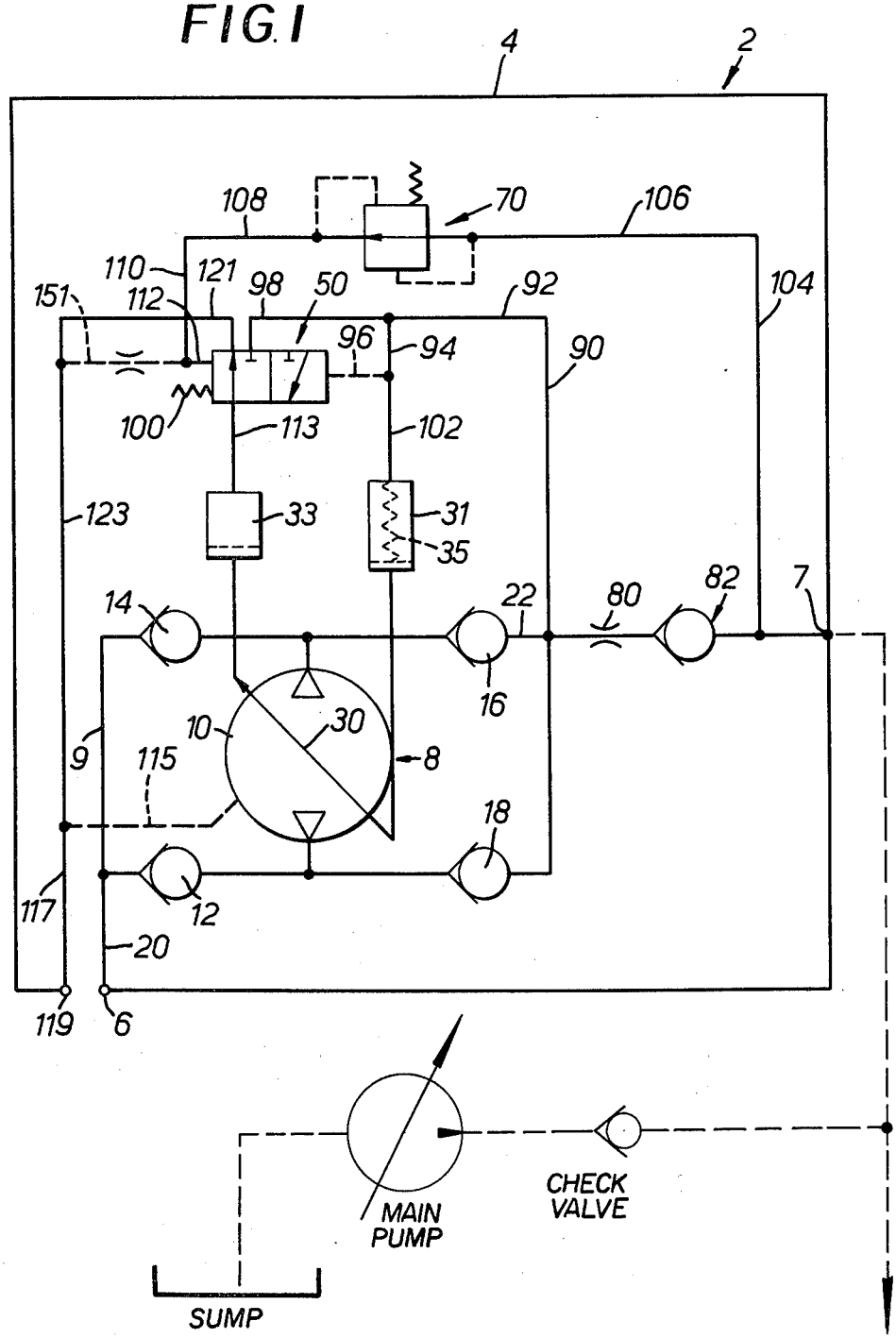
FIG. 1 is a schematic diagram of a hydraulic pump in accordance with the invention.

Referring to the drawings, there is shown a hydraulic pump 2 for pumping a hydraulic liquid through a hydraulic system (not shown). The pump 2 is designed to operate in the system as an auxiliary stand by pump that is normally in a stand-by condition and only becomes operative in the event of a failure in the system. The failure in the system may occur, for example, in the event of a system leak or a failure of a main pump normally supplying the system.

The pump 2 comprises a housing 4 having an inlet port 6 and a delivery port 7. In the stand-by condition of the pump 2, hydraulic liquid from the system is drawn into the inlet port 6, passes through the pump 2 and re-enters the system via the delivery port 7.

The pump 2 also comprises pumping means 8. As shown in FIG. 1, the pumping means 8 is a reversible pump comprising a pumping section 10 feeding non-return ball valves 12, 14, 16, 18. The pumping section 10 is illustrated most clearly in FIG. 2 and it will be seen that it comprises a drive shaft 24 having an external portion 26 provided with splines 28. The splines 28 mate with appropriate drive means for rotating the shaft 24 clockwise or anti-clockwise as desired. The shaft 24 is splined to a rotor body 42 and causes the body 42 to rotate. Pumping pistons 38 are carried within the body 42 and operate in cylinders or bores 40 also arranged in the body 42. The pistons 38 have ball heads 36 attached to housing members or slippers 32. The slippers 32 each have a depression 34 for receiving one of the ball heads 36. The slippers 32 rotate with the body 42 and run against the swash plate 30 which does not rotate.

The pistons 38 are provided with a large central bore 44 and a small bore 46 allowing hydraulic fluid to pass to the external surface of the ball head 36 for lubrication purposes. The stroke of the pistons 38 increases with the angle of tilt of the swash plate 30 and the greater the stroke of the pistons 38, then the greater is the amount of the liquid pumped.

The pumping section 10 is reversible so that if the shaft 24 is driven one way, then the valves 12, 16 will be open and the valves 14, 18 will be closed. If the shaft 24 is driven the other way, then the valves 14, 18 will be open and the valves 12, 16 will be closed. Thus, whichever way the shaft 24 is driven, liquid can enter the pump inlet port 6, can pass along the conduit 20, through the pumping means 8 and out at the conduit 22.

The angle of tilt of the swash plate 30 is determined by two piston-and-cylinder arrangements 31, 33, see FIG. 1. The first piston-and cylinder arrangement 31 is operative to move the swash plate 30 to an on-swash condition and the second piston-and-cylinder arrangement is operative to move the swash plate 30 to a de-swashed condition. The precise operation of the piston-and-cylinder arrangements 31, 33 will be described hereinbelow.

The pump 2 also comprises control means 50 for controlling the flow of liquid to the piston-and-cylinder arrangement 33. The control means 50 is shown in FIG.

Figure 2:
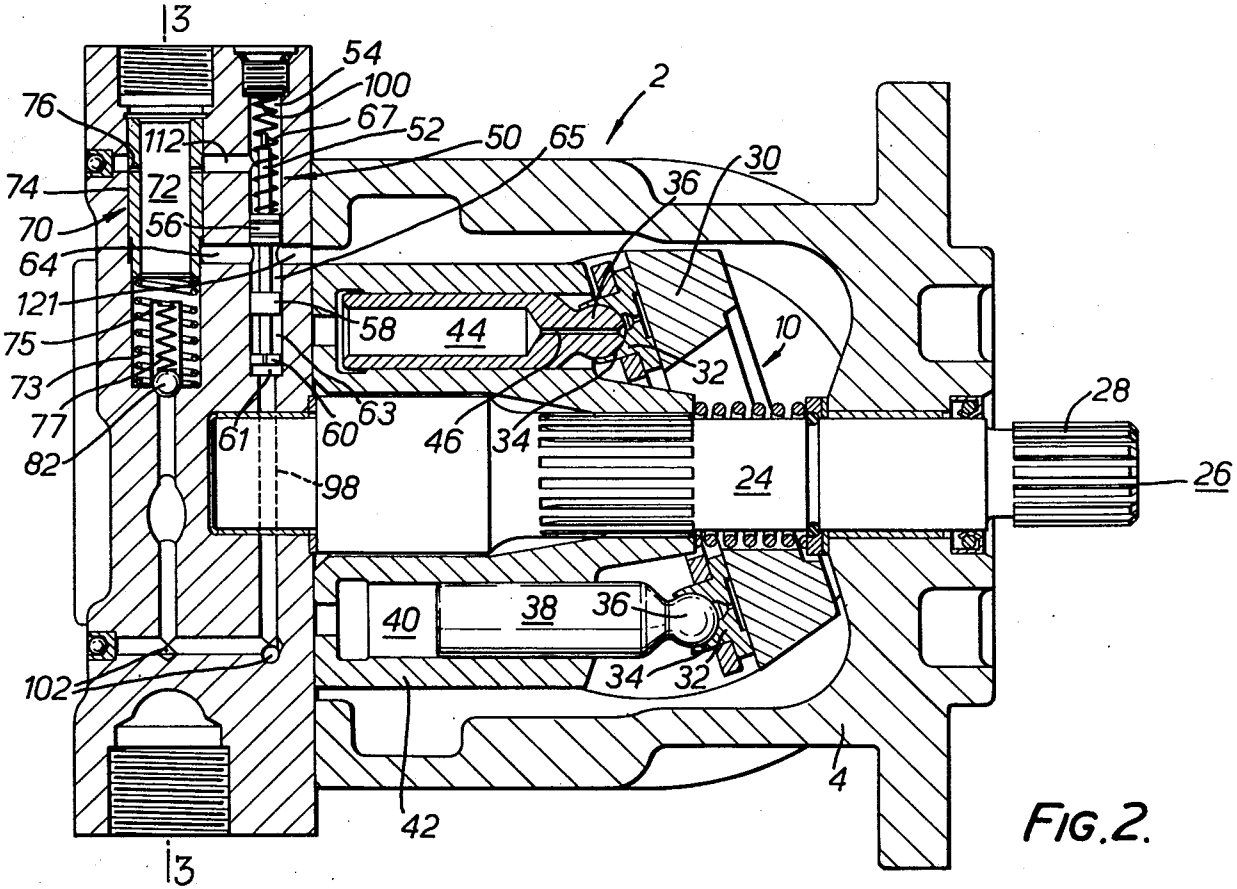
FIG. 2 is an axial section through the hydraulic pump illustrated schematically in FIG. 1.

1 in somewhat diagrammatic form. It can be seen however from FIG. 2 that the control means 50 includes a spool valve 52 operating in a cylinder 54. The spool valve 52 is provided with three lands 56, 58, 60. The lands 56, 58, 60 define chambers 61, 63, 65, 67 in the cylinder 54. In the chamber 67 there is a spring 100 which biases the spool valve 52 downwardly as shown in FIG. 2. Chambers 61, 63 are permanently connected by a conduit formed by flats on the land 60 of the spool valve 52.

The pump 2 further comprises switching means 70. The switching means 70 is shown somewhat diagrammatically in FIG. 1. It can however be seen from FIGS. 2 and 3 that the switching means 70 comprises a spool valve 72 which operates in a cylinder 74. The spool valve 72 has three diameters caused by two shoulders 72A and 72B on the valve 72. The cylinder 74 has three diameters caused by two shoulders 74A and 74B on the cylinder 74. The cylinder 74 is in communication with the flow conduits 112, 64 and there is also a further small bore passage 76. The spool valve 72 is biassed upwardly as shown in FIG. 2 by means of a spring 73 operating outside a spool valve guide shroud 75. Operating within the shroud 75 is a spring 77 operative to close a valve 82, see FIGS. 1 and 2.

The switching means 70 is operative to pass hydraulic liquid from the system at conduit 106 to the control means 50 via passage 76 and conduit 112 at a first pressure condition in the hydraulic system. The switching means 70 is also operative to stop hydrualic fluid from the system passing to the control means 50 at a second and higher pressure condition in the external system. At this second pressure condition, spool valve 74 will overcome the spring 73 due to the pressure in the conduit 106 and will move down until the passage 76 is disconnected from the conduit 112. Pressure in chamber 67 will drop by leakage past the land 56 to the conduit 121 which is at tank pressure. The spool valve 52 will move fully upwards under the pressure in the conduit 98 against the spring 100. This will connect delivery pressure in the conduit 98 (see FIG. 1) via the conduit 113 to the de-swashed piston-and-cylinder arrangement 33. Th pump will fully destroke.

The pump 2 further comprises a fixed flow control orifice 80 and the non-return ball valve 82.

The operation of the pump 2 is as follows. In the stand by condition, the inlet port 6 of the pump 2 is drawing hydraulic liquid from the system. As presently envisaged, the hydraulic system will be fitted to a dumper truck or a tractor and the external portion 26 of the shaft 24 will be fitted to a rotating shaft of the truck or tractor, e.g., an axle or propeller shaft. Depending upon the way in which the shaft (not shown) is rotating, the pair of valves 12, 16 or 14, 18 will be open and the other pair of valves respectively will be closed. The system liquid can thus pass through the pumping means 8 to the conduit 22. The liquid in the conduit 22 will not be able to pass through the non-return ball valve 82 when in the stand by condition.

Figure 3:
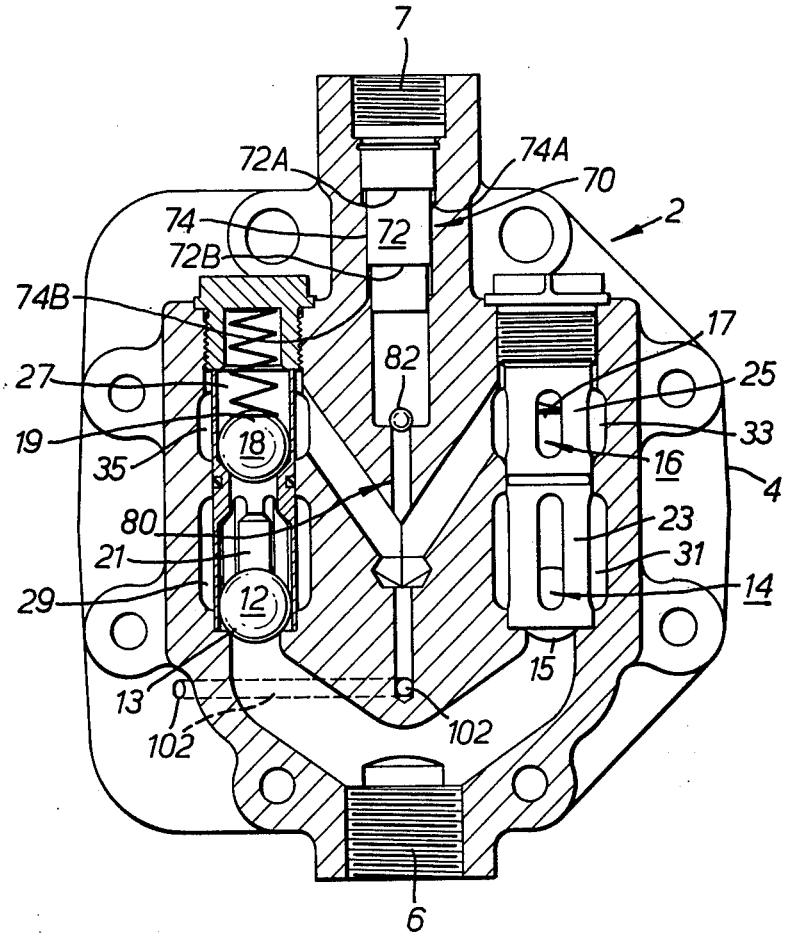
FIG. 3 is a cross section on the line 3—3 shown in FIG. 2.

As shown most clearly in FIG. 3, the valves 12, 14, 16, 18 include a ball 13, 15, 17, 19 respectively. The balls sit on valve seats and are surrounded by sleeves 21, 23, 25, 27 respectively. The sleeves are provided with longitudinal slots as shown in FIG. 3 to enable the liquid to pass through the sleeves 21, 23, 25, 27 into liquid galleries 29, 31, 33, 35.

The pressure in the line 22 is sensed via conduits 90, 92, 94, 96 as a high pressure at the right hand end of the flow control spool 52. Since in the stand by condition the switching means 70 is closed, the pressure in conduits 104, 106 is not connected to conduits 108, 110, 112. Pressure in conduits 108, 110, 112 therefore drops to tank pressure through bleed orifice 151. Hence pressure on the rear of spool 52 is also at tank pressure.

The left hand end of the flow control spool 52 is provided with a light opposing force from the biassing spring 100 which may be set to a preload, equivalent for example to 300 p.s.i. pressure difference across the two ends of flow control spool 52.

In the stand by condition, the pressure in the conduit 92 will be sensed in the conduit 98. The pressure in the conduit 98 will be sensed in chambers 61, 63 of the control means 50 and then in the conduit 113. The pressure in the conduit 113 will bias the piston-and-cylinder arrangement 33 to its de-swashed condition since it will counteract the on-swash action of the piston-and-cylinder arrangement 31. In the stand-by condition, the swash plate 30 will be at a slight angle due to the action of the spring 100 so that a very slight amount of liquid will be pumped by the pumping section 10, but this pumped liquid will be internally bled along conduit 115 and conduit 117 to a drain port 119 and there will be no liquid pumped to the delivery port 7.

In the event of a system failure, there will be a drop in the hydraulic pressure in the system and this drop in pressure will be sensed in the conduits 104, 106. When this pressure drops sufficiently low, the switching means 70 will become activated and it will allow liquid to pass through it to the conduits 108, 110, 112.

The liquid in the conduit 112 will act with the spring 100 to bias the spool valve 52 to the right as shown in FIG. 1 and this will stop the connection between conduits 98, 113. Conduit 113 will now be connected to conduits 121, 123, 117 so that the piston-and- cylinder arrangement 33 is effectively connected to tank via the drain port 119. The piston-and cylinder arrangement 33 will thus move back from its de-swashing condition so that the piston-and-cylinder arrangement 31 will be effective to move the swash plate 30 to an appreciable on-swash condition. The increased angle of the swash plate 30 causes the pumping piston-and-cylinders 38, 40 to operate such that the pumping stroke of the pistons 38 is increased. The pumping section 10 will thus be caused to deliver an output and it will be effective to pump liquid along conduit 22, through the flow control orifice 80 and the ball valve 82 to the delivery port 7. The pumping means 8 will thus be effective to maintain the falling pressure in the external circuit.

The liquid pumped by the pumping section 10 will be sensed across the flow control orifice 80. The pressure downstream of the flow control orifice 80 will be sensed via conduits 104, 106, 108, 110, 112 and is sensed on the left hand end of the spool 52. The pressure upstream of the orifice 80 is sensed via conduits 90, 92, 94, 96 on the right hand end of the spool 52. The flow control orifice 80 is thus arranged such that typically 300 p.s.i. pressure drop is achieved across it at the required control flow. When this flow is reached the spool 52 will move back against its bias spring 100, thus setting the pump swash at the control rate. The orifice 80 can thus be arranged to ensure that the pumping means 8, in the emergency condition, pumps at a predetermined and controlled rate. If the pumping means 8 is pumping too much or too little liquid, then this will be sensed as a change in pressure drop at the flow control orifice 80. The spool valve 52 will be caused to move and balance the piston-and-cylinder arrangements 31, 33 to give the correct angle of the swash plate 30.

When the system pressure has risen sufficiently high, it will be felt in the conduits 104, 106 and the switching means 70 will operate again and will stop the liquid in the conduit 106 passing to the conduits 108, 110, 112. At this moment in time, the higher pumping pressure will still be felt in the conduits 90, 92, 94, 96. The spool valve 52 will thus be biased back towards its original stand-by position. Conduit 113 will no longer be connected to tank via conduit 112 and conduits 113, 98 will be reconnected. The de-swash piston-and-cylinder arrangement 33 will become active and will de-swash the swash plate 30 to reduce the pumping output of the pumping means 8 back to its original stand by condition.

In the start up condition of the system, the ball valve 82 will be closed. This will open as soon as the pressure in line 22 reaches the pressure level at delivery port 7.

Figure 4:
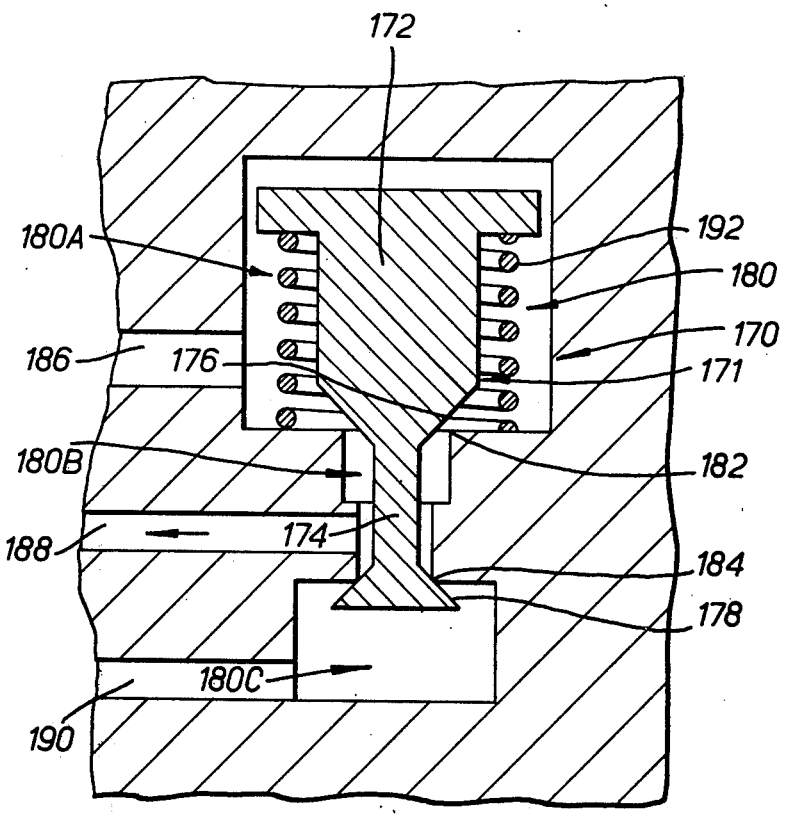
FIG. 4 shows a modification for part of the pump shown in FIGS. 2 and 3.

In an alternative embodiment of the invention, the switching means 70 shown in FIGS. 2 and 3 can be replaced by the switching means 170 shown in FIG. 4.

The switching means 170 comprises a two part poppet valve 171 having an upper body portion 172 and a lower body portion 174 which screws into the upper body portion 172. The valve 171 has a first tapered section 176 and a second tapered section 178.

The valve 171 operates in a chamber 180 having a first valve seat 182 and a second valve seat 184 which is slightly smaller than the valve seat 182.

Chamber 180 has three sections 180A, 180B, 180C. Each chamber section is provided with a conduit. More specifically, a conduit 186 connects the chamber section 180A to the conduit 6, see FIGS. 2 and 3. A conduit 188 connects with the chamber section 108B with the control means at the cylinder 54. A conduit 190 connects the chamber section 180C with the pump casing via the conduit 121.

A spring 192 holds the poppet section 178 against the valve seat 184 at a first pressure condition. The conduit 186 then connects through the chamber section 180A, past the gap between the poppet section 176 and the valve seat 182, through the chamber 180B and the conduit 188 to the control means at the cylinder 54. Hence pump delivery pressure is felt on both sides of the spool valve 52 and the pump maintains flow at an appropriate level dictated by the orifice 80.

At a second pressure condition, delivery pressure is felt via the conduit 186, through the chamber section 180A and the chamber section 180B. This delivery pressure lifts the poppet section 178 off its seat 184, thereby overcoming the spring 192. The poppet sections 176 and 178 move downward until the poppet section 176 closes on its seat 182. The cylinder 54 of control means 50 is thus disconnected from the delivery pressure and is now connected via the chamber section 180B at the gap between the poppet section 178 and the valve seat 184, to the chamber section 180C and conduits 190 and 121 to tank pressure. As in the embodiment of the invention described above with reference to FIGS. 1–3, the spool valve 52 moves fully back under the action of the delivery pressure in the conduit 98 against the spring 67.

At a third pressure condition lower than the second pressure condition but higher than the first pressure condition, the poppet valve 171 will move upwards under the action of the spring 192. This causes the tapered section 176 to leave its seat 182, and the tapered section 178 to reconnect with its seat 184. Conditions described above for the first pressure condition will then reapply. This third pressure condition occurs at a lower pressure condition than the second pressure condition because of the difference in diameter of the valve seats 182 and 184.

It is to be appreciated that the embodiments of the invention described above have been given by way of example only and that modifications may be effected. Thus, for example, the flow control orifice 80 could be omitted to remove the control over the output of the pumping means 8. Also, other types of switching valve and flow control valve can be employed, depending on the intended use of the pump. Thus, for example, the pump 2 could be used as a part of aircraft auxiliary ground equipment or indeed in any circuit that has a pressure accumulator. Still further, the illustrated pump could be modified so that one or more of its components could be located outside of the housing 4. The various components of the hydraulic pumping arrangement need not be contained in one single housing and the various components may be physically separated from each other and connected only by appropriate liquid or electrical connections as required.

What is claimed is:

1. A hydraulic pumping arrangement for pumping a liquid to a hydraulic system, which comprises reversible pumping means for pumping the liquid, swash means including a variable swash member which enables the liquid output of the pumping means to be infinitely varied between minimum and maximum, a first piston-and-cylinder arrangement for increasing the position of the swash member to increase the liquid output of the pumping means, a second piston-and-cylinder arrangement for decreasing the position of the swash member to decrease the liquid output of the pumping means, control means for controlling the flow of liquid for the second piston-and-cylinder arrangement, switching means operative to pass liquid from the system to the control means at a first condition in the system and operative to stop liquid from the system passing to the control means at a second condition in the system, and valve means for isolating the pumping arrangement from the system and from a main pump normally supplying liquid to the system, the control means being operative when it is receiving liquid from the switching means to enable the swash member to be moved to an on-swash condition and therefore the pumping means to pump liquid to the system in the event of a lack of liquid output from the main pump.

2. A hydraulic pumping arrangement according to claim 1 in which the valve means is a ball valve.

3. A hydraulic pumping arrangement according to claim 1 including a control orifice which operates together with the second piston-and-cylinder arrangement and the control means to enable a precise control to be achieved over the output of the pumping means.

4. A hydraulic pumping arrangement according to claim 1 in which the switching means is operative to pass liquid from the system to the control means at a first pressure condition in the system and is operative to stop liquid from the system passing to the control means at a second pressure condition in the system.

5. A hydraulic pumping arrangement according to claim 4 in which the first pressure condition occurs at a lower pressure than the second pressure condition.

6. A hydraulic pumping arrangement according to claim 1 in which the switching means includes a spool valve.

7. A hydraulic pumping arrangement for pumping a liquid to a hydraulic system, which comprises reversible pumping means for pumping the liquid, swash means including a variable swash member which enables the liquid output of the pumping means to be infinitely varied between minimum and maximum, a first piston-and-cylinder arrangement for increasing the position of the swash member to increase the liquid output of the pumping means, a second piston-and-cylinder arrangement for decreasing the position of the swash member to decrease the liquid output of the pumping means, control means for controlling the flow of liquid for the second piston-and-cylinder arrangement, switching means operative to pass liquid from the system to the control means at a first pressure condition in the system and operative to stop liquid from the system passing to the control means at a second and higher pressure condition in the system, a control orifice which operates together with the second piston-and-cylinder arrangement and the said control means to enable a precise control to be achieved over the output of the pumping means, and ball valve means for isolating the pumping arrangement from the system and from a main pump normally supplying the liquid to the system, the control means being operative when it is receiving liquid from the switching means to enable the swash member to be moved to an on-swash condition and therefore the pumping means to pump liquid to the system in the event of a lack of liquid output from the main pump.

* * * * *